US010767963B2

(12) United States Patent
Sun et al.

(10) Patent No.: US 10,767,963 B2
(45) Date of Patent: Sep. 8, 2020

(54) GUN CALIBRATOR PROVIDED WITH INNER RED DOT SIGHT

(71) Applicants: HUANIC CORPORATION, Xi'an, Shaanxi (CN); Jianhua Sun, Xi'an, Shaanxi (CN)

(72) Inventors: Jianhua Sun, Shaanxi (CN); Yanpeng Song, Shaanxi (CN)

(73) Assignees: Huanic Corporation, Xi'an, Shaanxi (CN); Jianhua Sun, Xi'an, Shaanxi (CN)

( * ) Notice: Subject to any disclaimer, the term of this patent is extended or adjusted under 35 U.S.C. 154(b) by 250 days.

(21) Appl. No.: 16/066,018

(22) PCT Filed: Dec. 4, 2016

(86) PCT No.: PCT/CN2016/108474
§ 371 (c)(1),
(2) Date: Jun. 25, 2018

(87) PCT Pub. No.: WO2017/107759
PCT Pub. Date: Jun. 29, 2017

(65) Prior Publication Data

US 2019/0011225 A1 Jan. 10, 2019

(30) Foreign Application Priority Data

Dec. 23, 2015 (CN) ..... 2015 1 0978416

(51) Int. Cl.
*F41G 1/54* (2006.01)
*F41G 3/32* (2006.01)
*F41G 11/00* (2006.01)

(52) U.S. Cl.
CPC ..... *F41G 1/545* (2013.01); *F41G 1/54* (2013.01); *F41G 3/323* (2013.01); *F41G 11/003* (2013.01)

(58) Field of Classification Search
CPC ..... F41G 1/545; F41G 1/54
USPC ..... 33/286, 263, 506
See application file for complete search history.

(56) References Cited

U.S. PATENT DOCUMENTS 4,825,258 A * 4/1989 Whitson ..... F41G 1/54 33/286
5,396,708 A * 3/1995 Whitley ..... F41G 3/323 279/2.02
5,446,535 A * 8/1995 Williams ..... F41G 3/323 33/286

(Continued)

FOREIGN PATENT DOCUMENTS

CN 2472188 Y 1/2002
CN 102109301 A 6/2011

(Continued)

OTHER PUBLICATIONS

International Search Report of PCT/CN2016/108474 dated Mar. 7, 2017.

*Primary Examiner* — Christopher W Fulton
(74) *Attorney, Agent, or Firm* — Amster, Rothstein & Ebenstein LLP

(57) ABSTRACT

A gun calibrator provided with an inner red dot sight includes a straight bar, a laser module displaced in the front end of the straight bar and is coaxial with the straight bar, and a battery cabin that is displaced in the front end of the straight bar, wherein the front end of the straight bar is provided with an inner red dot sight.

20 Claims, 10 Drawing Sheets

(56) References Cited

U.S. PATENT DOCUMENTS

| | | | | |
|---|---|---|---|---|
| 6,289,624 | B1 | 9/2001 | Hughes et al. | |
| 6,295,753 | B1 | 10/2001 | Thummel | |
| 6,397,509 | B1 * | 6/2002 | Langner | F41G 1/54 42/111 |
| 6,457,246 | B1 * | 10/2002 | Frazer | E21D 9/004 33/286 |
| 8,393,108 | B1 * | 3/2013 | Wilson | F41G 11/003 42/111 |
| 9,057,583 | B2 * | 6/2015 | Matthews | F41G 1/30 |
| 2002/0088129 | A1 * | 7/2002 | Huang | F41G 1/35 33/286 |
| 2007/0039225 | A1 * | 2/2007 | Kallio | F41G 1/35 42/146 |
| 2012/0106170 | A1 * | 5/2012 | Matthews | F41G 1/30 362/311.06 |
| 2012/0216440 | A1 * | 8/2012 | Riley | F41G 1/35 42/146 |
| 2015/0241161 | A1 * | 8/2015 | Hodgson | F41A 21/32 89/14.3 |
| 2018/0080738 | A1 * | 3/2018 | Patton | F41G 1/54 |

FOREIGN PATENT DOCUMENTS

| | | | |
|---|---|---|---|
| CN | 202339144 | U | 7/2012 |
| CN | 103339463 | A | 10/2013 |
| CN | 204268972 | U | 4/2015 |
| CN | 205448838 | U | 8/2016 |

* cited by examiner

GUN CALIBRATOR PROVIDED WITH INNER RED DOT SIGHT

CROSS REFERENCE

The present application is a continuing application of International Application No. PCT/CN2016/108474, filed on Dec. 4, 2016, which is based upon and claims priority to Chinese Patent Application No. 201510978416.5, filed on Dec. 23, 2015, and the entire contents thereof are incorporated herein by reference.

TECHNICAL FIELD

The present disclosure relates to a gun calibrator with an inner red dot sight.

BACKGROUND

Most modern guns are provided with a white light optical sight or red dot sight. After the sight is installed, the gun needs to be calibrated prior to using it. The fundamental method is target shooting practice, i.e., the gun is calibrated after each shooting till the correct position is reached. This method wastes time and bullets. After that, a calibration mirror for gun, a laser red dot bullet and a muzzle laser red dot rod and the like are successively developed.

Among them, a muzzle laser red dot rod, as shown in FIG. 1, mainly consists of a straight bar 1 that is inserted into a barrel, a laser device 2 that is installed coaxially with the straight bar and in the rear end of the straight bar 1, and a battery cabin 3 that accommodates battery. This kind of gun calibrator has simple structure, and high adjustment accuracy of gun calibration, but has the following obvious defects: low amount of battery power, frequent replacement of battery, and poor concentricity of the gun calibrator with the barrel that leads to large errors.

Compared with the gun calibrator shown in FIG. 1, the gun calibrator shown in FIG. 2 has an annular limit elastic ring 29 that is displaced in a rear end portion of the straight bar 1 (that is, the end in which the laser device is not installed, i.e., the left side shown in this figure). The annular limit elastic ring 29 can ensure that the straight bar 1 is in close contact with the inner wall of a barrel. Further, there is a variable diameter section 30 in the center part of the straight bar 1 near the battery cabin 3. The variable diameter section 30 is a truncated cone with an increasing diameter toward the battery cabin 3 that gradually becomes larger than the inner diameter of the barrel to form limits on two ends together with an annular limit elastic ring 4, thereby effectively improving the coaxiality of the straight bar 1, the laser module 2 and the barrel. Further, the battery cabin 3 is relatively large (and integrated with the laser module 2), can accommodate batteries with a large volume, and thus, has a good battery endurance. However, a larger force, in particular gravity due to the battery with a large volume to be installed, is applied on the annular limit elastic ring 29 at the rear end thereof, resulting in an unavoidable phenomenon, i.e., the front end of the straight bar 1 is raised upwardly. Therefore, ideal coaxiality has not been reached yet.

Either the gun calibrator shown in FIG. 1 or the gun calibrator shown in FIG. 2 has a single function, i.e., providing a single light source for laser irradiation. The single laser type of gun calibrator is affected by the environmental, i.e., it can only be used indoors under dim light. In an outdoor environment under intense light, this type of gun calibrator cannot be used since the laser light point is blurred under the ambient light. Therefore, the scope of application is limited.

SUMMARY

According to one aspect of the present disclosure, a gun calibrator provided with an inner red dot sight, which comprises a straight bar, a laser module that is displaced in the front end of the straight bar and is coaxial with the straight bar, and a battery cabin that is displaced in the front end of the straight bar, and is characterized in that the inner red dot sight is displaced in the front end of the straight bar.

The inner red dot sight is displaced on the top end of the laser module.

The inner red dot sight is connected with the laser module by a Picatinny rail displaced on the top end of the laser module.

The inner red dot sight is connected with the top end of the laser module by a sight bracket, which is displaced in the bottom of the inner red dot sight and can be clamped by the Picatinny rail.

The laser module is displaced in the front end portion of the straight bar, and the Picatinny rail is displaced on the top end of the front end portion of the straight bar.

In order to ensure the concentricity of the gun calibrator with the barrel during calibration, the rear end of the straight bar is a truncated cone with an increasing diameter toward the front end of the straight bar, on which an expansion sleeve that is coaxial with the straight bar is sleeved, and an end of the expansion sleeve in which a longitudinal expansion gap is provided is sleeved on the straight bar, and at least one annular elastic member is sleeved on an outer wall of the other end of the expansion sleeve.

In order to facilitate assembly and disassembly of the battery cabin and use a battery with large amount of power, a sleeve that is sleeved on the front end of the straight bar is displaced at the top surface of the battery cabin. An inner hole of the sleeve is coaxial with the straight bar after installation.

The bottom surface of the battery cabin and the top surface of the sleeve are respectively provided with a Picatinny rail.

A control circuit board is provided in the front end portion of the battery cabin, and the front end portion is provided with a control button in communication with the control circuit board.

The top surface of the rear end of the battery cabin is provided with a through hole in communication with the rear end portion of the bottom surface of the sleeve. The rear end portion of the bottom surface of the sleeve is provided with a negative electrode post and a positive electrode post having elastic property, which are displaced up and down.

The rear end of the straight bar that is in the central part near the battery cabin is provided with a conical protruding part with an increasing radius toward the battery cabin. The front end surface of the conical protruding part is provided with an annular conductive plate that is sleeved on the straight bar, and the front side surface of the annular conductive plate is provided with an outer conductive ring and an inner conductive ring.

The annular conductive plate can be embedded in the rear end portion of the sleeve, such that the outer conductive ring and the inner conductive ring are respectively in communication with the positive electrode post and the negative electrode post with elasticity.

An outer circumferential edge and an inner circumferential edge of the annular conductive plate are respectively provided with an outer notch that facilitates bonding wire and an inner notch. The outer notch and the inner notch are respectively connected with the outer conductive ring and the inner conductive ring.

The top surface of the rear end of the battery cabin is provided with a through hole in communication with the rear end portion of the bottom surface of the sleeve.

The rear end portion of the sleeve is provided with a conductive pillar, which is displaced to be parallel to the axial direction of the straight bar. A conductive ball and a conductive spring are embedded in the circumferential surface of the straight bar, which is embedded in the sleeve, and the conductive ball and the conductive spring are perpendicular to the straight bar.

The conductive ball is pressed against the surface of the battery cabin under the pressure of the conductive spring.

The rear end of the straight bar that is in the central part near the battery cabin is provided with a conical protruding part with an increasing radius toward the battery cabin. The front end surface of the conical protruding part is provided with an annular conductive plate that is sleeved on the straight bar, and the front side surface of the annular conductive plate is provided with a conductive ring.

The annular conductive plate can be embedded in the rear end portion of the sleeve. The conductive ring is in contact with the conductive pillar to connect one electrode of the laser module with an electrode of the battery placed in the battery cabin.

The conductive ball and the conductive spring connect a housing of the battery cabin and a shell of the sleeve. The other electrode of the laser module is connected with the other electrode of the battery placed in the battery cabin.

a clamp that can be clamped on the front end portion of the straight bar is displaced at the connection of the battery cabin and the sleeve. The clamp comprises: an inner thread connection sleeve displaced on one side of the connection, a connection screw across the connection, a movable clamping member displaced in a groove on the other side of the connection, and a cam wrench coupled to the end of the connection screw that penetrates the movable clamping member by a pin shaft.

The movable clamping member comprises a plate part and a cylinder part, wherein the plate part that is parallel to a side surface at the connection is provided with a horizontal via, and the cylinder part is fixedly connected to or integrated with the inner side surface of the plate part.

The top surface of the sleeve is connected with an inner red dot sight by the Picatinny rail.

The inner red dot sight is connected to the Picatinny rail by a Picatinny rail for increasing height that has a rapid clamping structure.

The rear end of the straight bar is a truncated cone with an increasing diameter toward the front end of the straight bar, on which an expansion sleeve that is coaxial with the straight bar is sleeved.

The front slip assembly and the rear slip assembly are connected by the connecting cylinder.

The front slip is surrounded to be a cylindrical shape by at least three front slips, the rear end of which is connected to the connecting cylinder and the front end portion of which is spherical or arc-shaped face. A gap is provided between the adjacent front gaps, and the outer diameter of the front slip is equal to the inner diameter of the barrel.

The rear slip assembly is surrounded to be a cylindrical shape by at least three rear slips. The front end of which is connected to the connecting cylinder and the rear end portion of which is spherical or curved face, and the outer wall of each spherical or curved surface is provided with a strip-shaped block that can be embedded in a rifling groove of a barrel. A gap is provided between the adjacent rear slips;

The diameter for the circumference where the block is located is equal to or slightly greater than the diameter of the circumference where the inside rifling of the barrel is located.

The connecting cylinder is screwed to the rear end of a straight bar.

LIST OF REFERENCE NUMERALS

Figure 1:
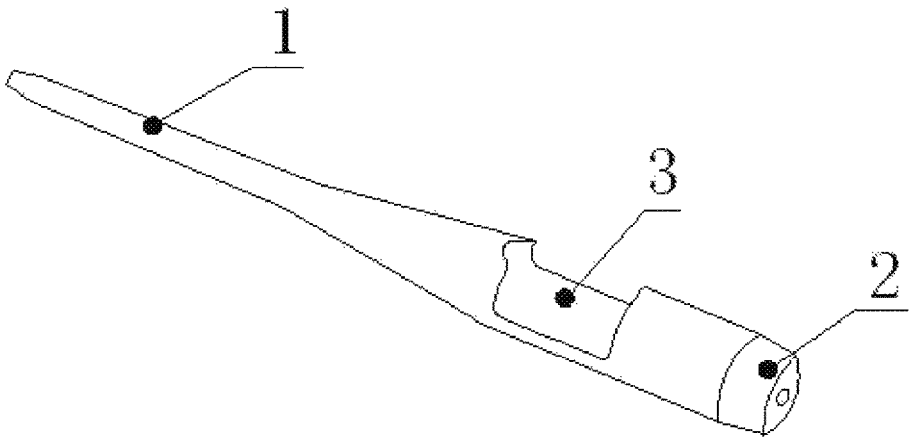
Fig. 1 (Prior Art)
FIG. 1 is a schematic structural view of a straight bar type red dot sighting telescope.
Figure 2:
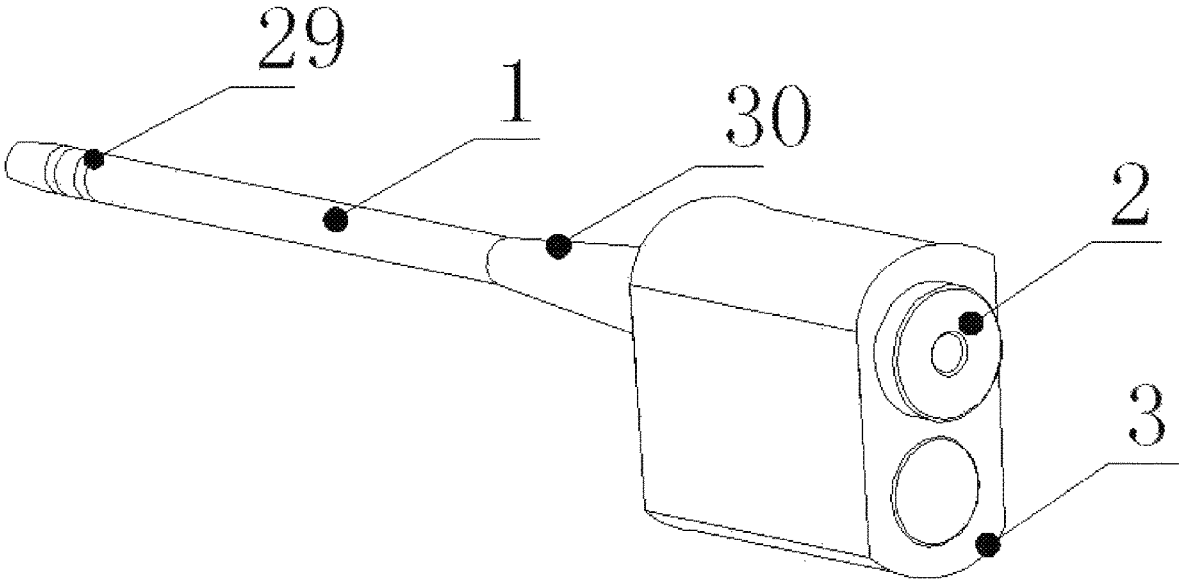
Fig. 2 (Prior Art)
FIG. 2 is a schematic structural view of the inner red dot sighting telescope provided with an integrated battery cabin.

1 straight bar,
2 laser module
3 battery cabin;
3-0 inner red dot sight
3-2 sight bracket
4 expansion sleeve

5 annular elastic member
6 sleeve;
3-1, 7, 8 Picatinny rail
9 control circuit board
10 control button;
11 through hole;
12 positive electrode post
13 conical protruding part
14 annular conductive plate;
15 outer conductive ring
16 inner conductive ring
17 outer notch
18 inner notch
19 threaded connecting sleeve
20 connection screw
21 movable clamping member
22 pin shaft
23 cam wrench;
24 horizontal via
25 plate part
26 cylinder part
27 inner red dot sight
28 Picatinny rail for increasing height
29 annular elastic restriction ring
30 variable diameter section
31 conductive pillar
32 conductive ball;
33 conductive spring;
34 vertical adjustment screw for laser module;
35 front slip assembly
36 rear slip assembly
37 connecting cylinder
38 front slip
39 block
40 rear slip

DETAILED DESCRIPTION

Figure 3A:
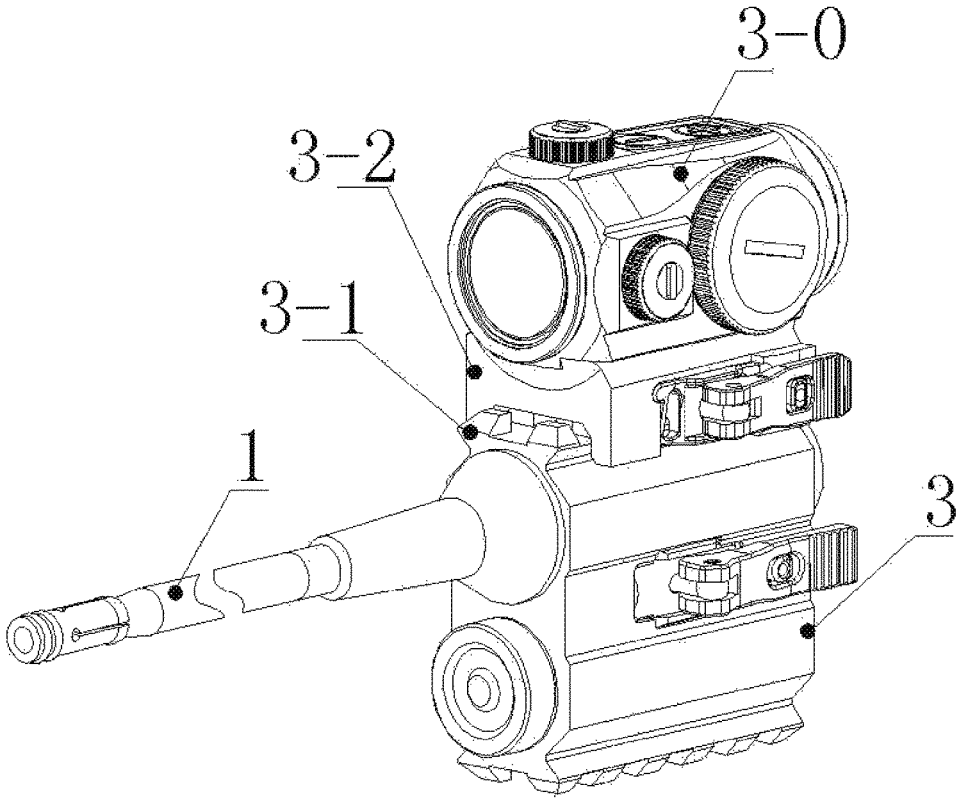
FIG. 3A is a schematic structural view of a gun calibrator according to present disclosure, in which a top end of a front end portion of a straight bar is provided with an inner red dot sight.

In order to overcome the problem that the existing gun calibrators cannot be used under intense light, an auxiliary device can be employed to realize normal use thereof. The present embodiment provides a gun calibrator provided with an inner red dot sight as shown in FIG. 3A, which comprises a straight bar 1, a laser module 2 that is displaced in the front end of the straight bar 1 and is coaxial with the straight bar 1, and a battery cabin 3 that is displaced in the front end of the straight bar 1. The improvement is that an inner red dot sight 3-0 is displaced in the front end of the straight bar 1, by which the aiming assistance is achieved. In particular, under intense light, even if the laser module 2 emits a laser with low visibility or even the laser module 2 is not used, the normal use of the gun calibrator may be ensured.

For convenience of use, i.e. for suiting usage habit, in the present embodiment, the inner red dot sight 3-0 is displaced on the top end of the laser module 2. In order to facilitate assembly or disassembly of the inner red dot sight 3-0, in particular a Picatinny rail 3-1 is installed or integrally manufactured at the top end of the inner red dot sight 3-0. Since the Picatinny rail is commonly used, the gun calibrator, in which the Picatinny rail is installed or into which the Picatinny rail is integrated, has good general applicability and can be used widely.

In order to suit the height of the aiming point or sight bead of different guns, the present embodiment provides a sight bracket 3-2, on the bottom of which the Picatinny rail can be clamped, to achieve assembly and disassembly of the inner red dot sight, and versatility, i.e. suiting different guns, thereby enhancing utility and universality. As shown in FIG. 3 B, when the height of gun's aiming point or sight bead is relatively high, the inner red dot sight is installed by two sight brackets. Of course, the top of the sight bracket that is directly connected to the front end portion of the straight bar 1 is integrally manufactured with the Picatinny rail.

To ensure a good coaxiality, the laser module 2 is further placed in the front end portion of the straight bar 1. The Picatinny rail 3-1 is correspondingly displaced on the top end of the front end portion of the straight bar 1, since the front end portion of the straight bar 1 is also used as a housing of the laser module 2.

Figure 3B:
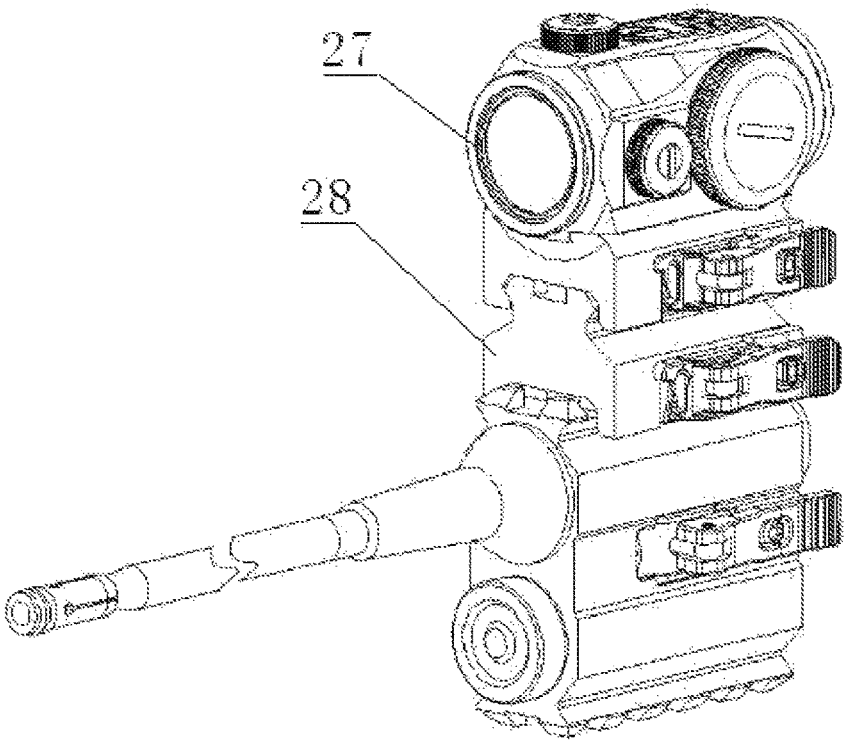
FIG. 3B is a schematic view of a gun calibrator, in which an inner red dot sight is installed by two sight brackets.
Figure 3C:
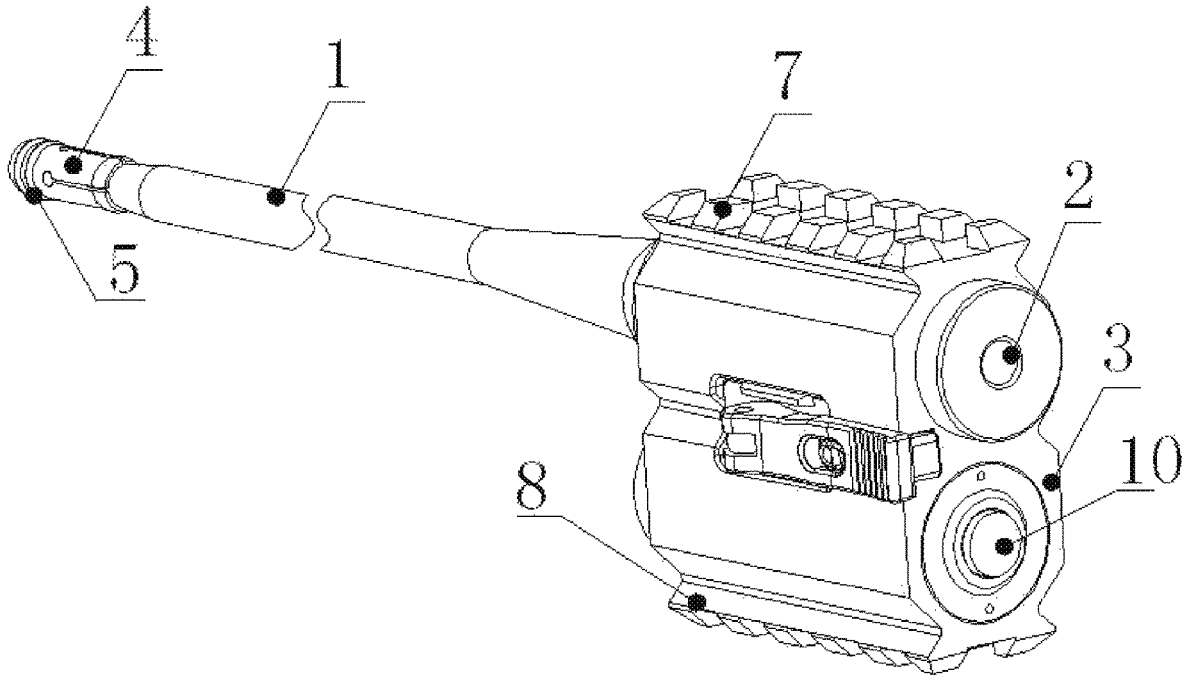
FIG. 3C is a schematic perspective structural view of a gun calibrator, in which a bottom surface of the battery cabin and a top surface of a sleeve are respectively provided with a Picatinny rail.
Figure 4:
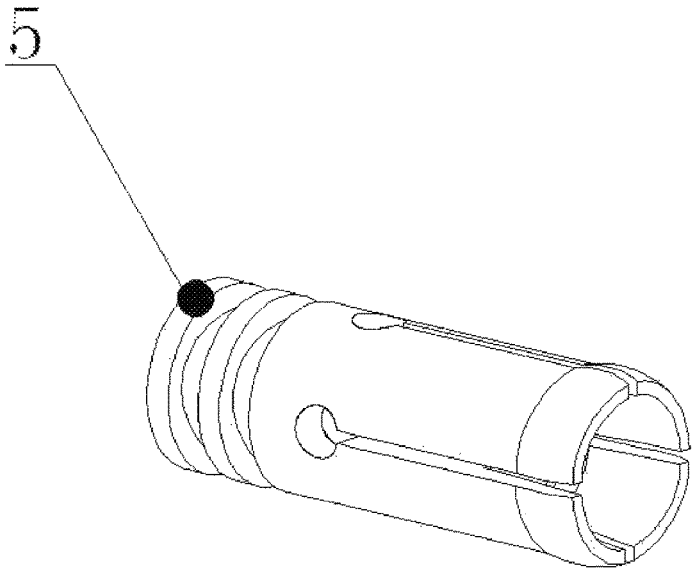
FIG. 4 is a schematic structural view of an expansion sleeve.

The gun calibrator as shown in FIG. 3C comprises a straight bar 1, a laser module 2 that is displaced in the front end of the straight bar 1 and is coaxial with the straight bar 1, and a battery cabin 3 that is sleeved on the front end of the straight bar 1. It can be seen from the figure that the rear end of the straight bar 1 is a truncated cone with an increasing diameter toward the front end of the straight bar 1, in which (the orientation in which the end that is inserted into the barrel when the gun is calibrated is called rear, and this end is called rear end) a expansion sleeve 4 shown in FIG. 4 is provided to be coaxial with the straight bar 1. One end of the expansion sleeve 4 in which a longitudinal expansion gap is provided is sleeved on the straight bar 1. The front end outer wall of the other end of the expansion sleeve 4 on which at least one annular elastic member 5 is sleeved, wherein the expansion sleeve 4 is connected to the rear end thread of the straight bar 1. When the straight bar 1 is rotated inwardly, the expansion sleeve is compressed to expand, such that the inner wall of the barrel and the expansion sleeve are in close contact with each other. Since forces in all directions are uniform, the stable state is maintained without skew. Further, since the straight bar 1, the expansion sleeve 4 and the laser module 2 installed in the rear end portion of the straight bar 1 have a good coaxiality, after the straight bar 1 is screwed in place, the expansion sleeve 4, the straight bar 1, and especially the laser module 2 and the barrel have a very good coaxiality, which realizes a high precision in calibrating the gun.

Figure 5:
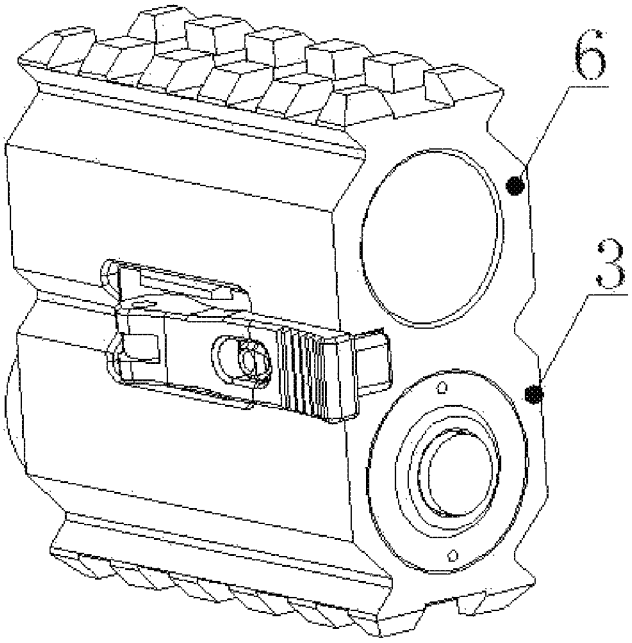
FIG. 5 is a schematic structural view showing that the battery cabin is integrally fit with the sleeve.

In order to meet requirement of sufficient battery endurance of laser modules, and in order to avoid a large disturbance caused by foreign objects in the process of adjusting concentricity of the laser module 2 with the barrel, the battery cabin 3 is provided detachably from the laser module 2 in the present embodiment. As shown in FIG. 5, a sleeve 6 that is sleeved on the front end of the straight bar 1 is displaced on the top surface of the battery cabin 3. The inner hole in the sleeve 6 is coaxially displaced with the straight bar 1, such that the battery cabin 3 is connected to the straight bar 1 and further connected to the laser module 2. This way, not only the problem that the concentricity is difficult to be adjusted and is readily affected by the battery cabin due to the integral design of the battery cabin 3 and the laser module 2 in existing technology is avoided, but also the replacement of the battery is more convenient and does not affect the concentricity of the laser module 2 with the barrel. The battery cabin 3 may be designed to be bigger to accommodate a battery with bigger volume and has higher amount of power, which supplies power for a longer time and avoids frequent replacement, thereby reducing adverse effects on the concentricity of the laser module with the barrel.

At the same time, the battery cabin 3 can be rotated around the straight bar 1 via the sleeve 6, such that after the straight bar 1 is clamped since the straight bar 1 is rotated to expand the expansion sleeve 4, the battery cabin 3 is adjusted in such a manner that the connecting line between the Picatinny rails 7 and 8 that are displaced at top end of the sleeve 6 or the bottom end of the battery cabin 3 is perpendicular to the axis of the straight bar 1, i.e. ensuring that the Picatinny rails 7 and 8 are parallel to the straight bar 1 and displaced in vertical direction. Therefore, the following problem is avoided: the Picatinny rails 7 and 8 are displaced on one side in the direction perpendicular to the axis of the straight bar 1 due to the fixation of the straight bar 1, such that the inner red dot sight is not connected to perform effective auxiliary aiming.

Figure 6:
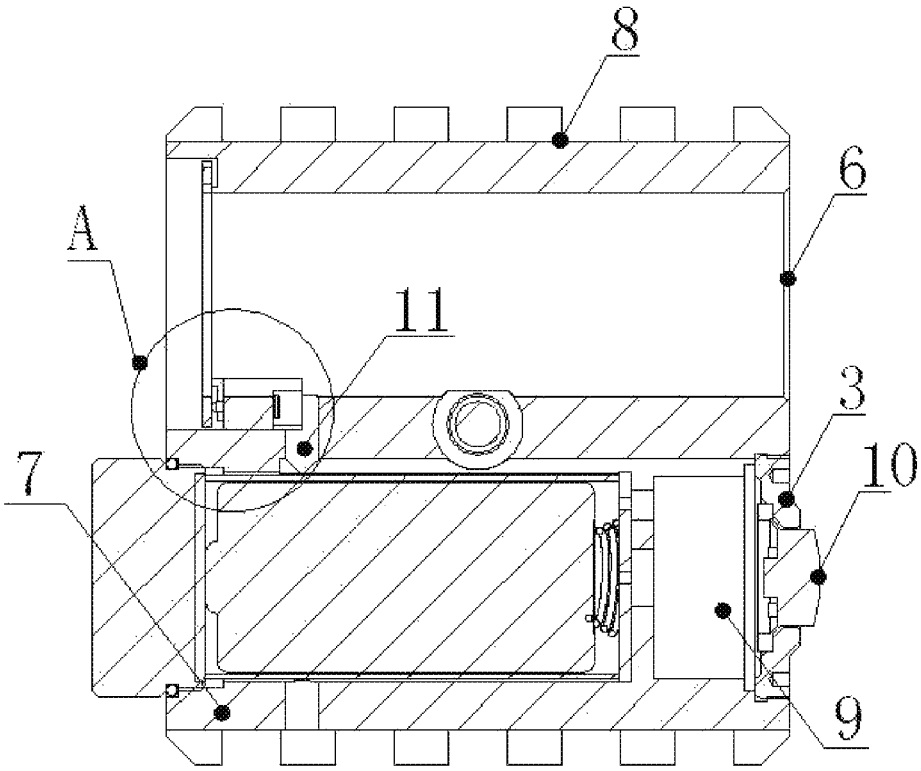
FIG. 6 is a schematic axial cross section view of FIG. 5.

In order to smoothly calibrate the gun under all environments, in particular under intense light, the Picatinny rails 7 and 8 as shown in FIG. 6 are respectively displaced on the bottom surface of the battery cabin 3 and the top surface of the sleeve 6, such that the sight can be installed on the sleeve 6 or the battery cabin 3, such as the inner red dot sight, to perform aiming and firing outdoors under a bright environment by means of the inner red dot sight. Since the battery cabin 3 can be rotated on the coaxial laser device, the Picatinny rails 7, 8 can be displaced on the top of the barrel via rotation. That is, the battery cabin 3 is displaced above the sleeve 6 after rotation. Therefore, two different heights for installing the inner red dot sight can be achieved, which is very convenient for use.

Figure 14:
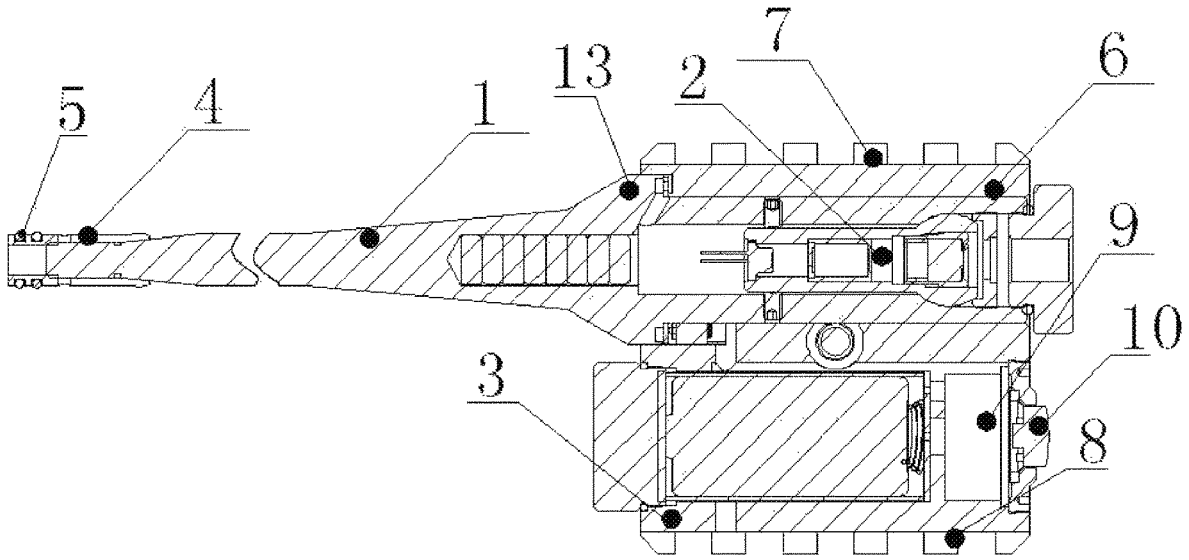
FIG. 14 is a schematic axial cross section view of the improved gun calibrator.
Figure 16:
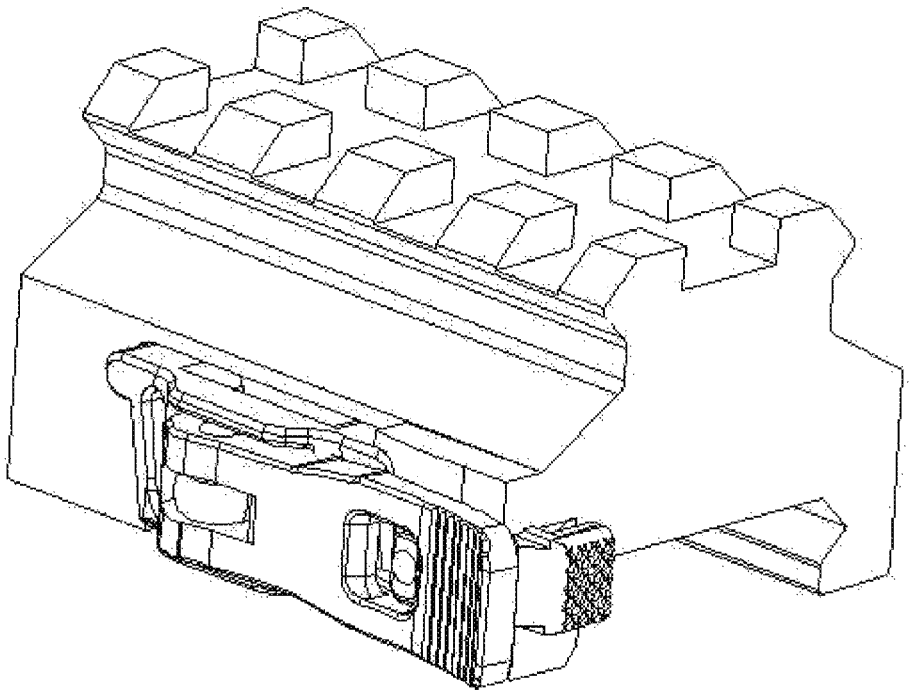
FIG. 16 is a schematic structural view of a Picatinny rail for increasing height.

As shown in FIG. 14, the top surface of the sleeve 6 is connected with an inner red dot sight 27 by the Picatinny rail. When the gun is larger or the height of the sight bead is greater, the inner red dot sight 27 may be connected to the Picatinny rail by a Picatinny rail 28 for increasing height that has a rapid clamping structure shown in FIG. 16. According to actual needs, the Picatinny rails 28 for increasing height as shown in FIG. 3B that have different heights and rapid clamping structure (has the same construction as the clamp structure) are selected. As shown in FIG. 3B, two Picatinny rails 28 for increasing height are employed to achieve the height adjustment of the inner red dot sight 27, enlarging application range of the gun calibrator.

Figure 7A:
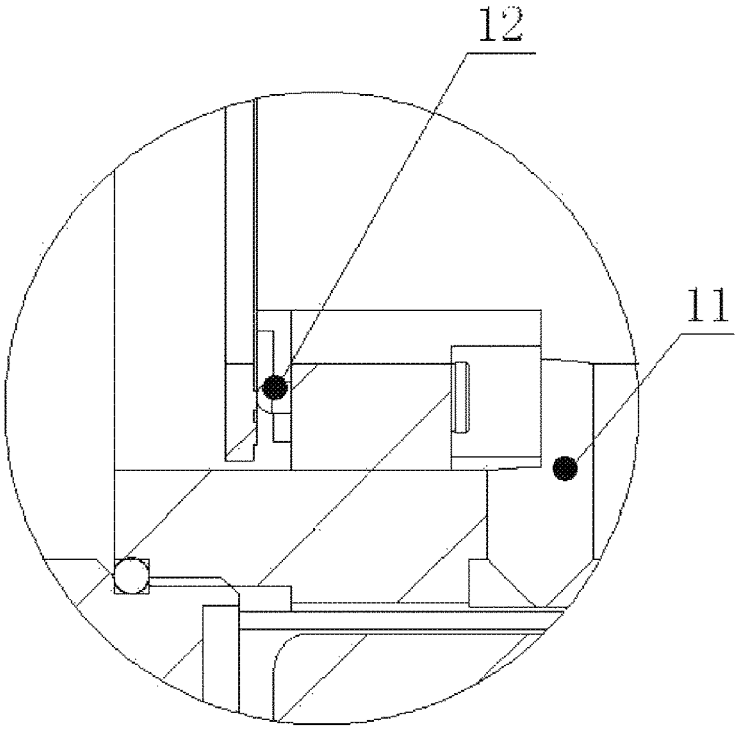
FIG. 7A is an enlarged schematic view of part A in FIG. 6.

As can also be seen from FIG. 6, a control circuit board 9 is displaced inside the front end portion of the battery cabin 3. A control button 10 is provided in communication with the control circuit board 9 in the front end portion, while a through hole 11 that is in communication with the rear end portion of the bottom surface of the sleeve 6 is provided in the top surface of the rear end of the battery cabin 3. A negative electrode post and a positive electrode post 12 having elastic property are displaced up and down in the rear end portion of the bottom surface of the sleeve 6, as shown in FIG. 7A, such that the control circuit board 9 is easily connected via wire. By means of the control circuit board 9 and the control button 10, the opening and closing of the laser module 2 and the switching and adjustment of output light power thereof can be achieved. For example, in a dark environment, the output light power is low, to prevent glaring in use and conserve battery power. Conversely, under intense ambient light, by increasing the output power of the laser module, generation of an obvious light spot aiming point is ensured.

Figure 8:
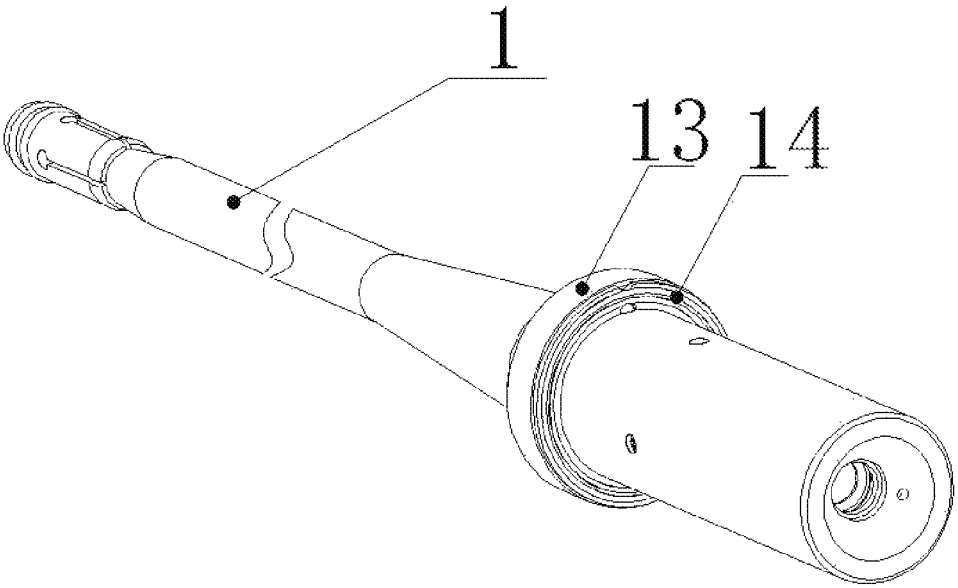
FIG. 8 is a schematic structural view of a straight bar type sight in which the sleeve and the battery cabin is not installed.
Figure 10:
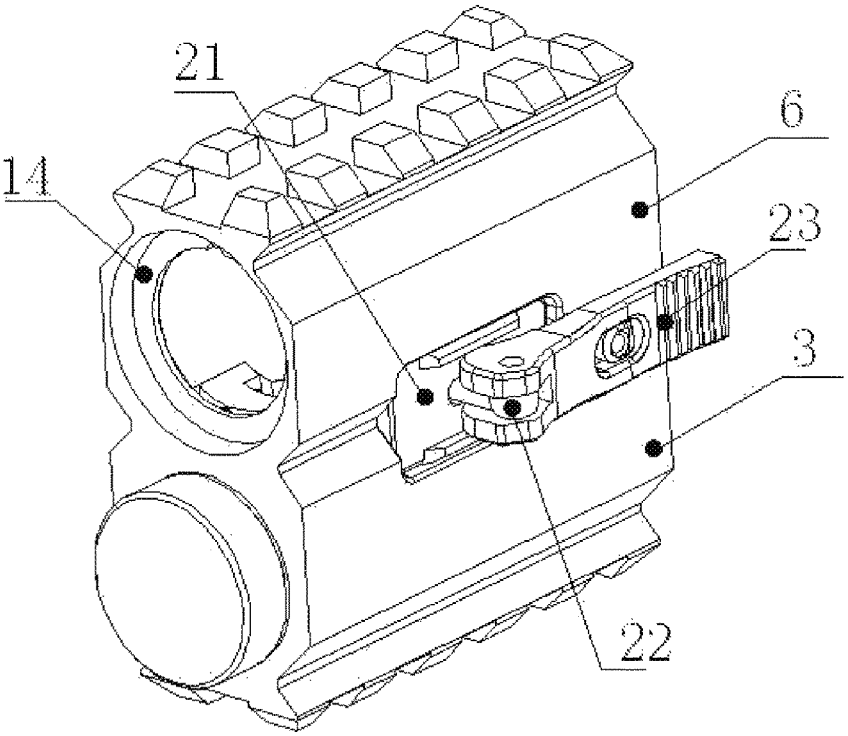
FIG. 10 is an isometric view in which the battery cabin is integrally fit with the sleeve.

In order to supply power to the laser module 2 and control the operation mode, the rear end portion of the straight bar 1 is provided with a conical protruding part 13 with an increasing radius toward the battery cabin 3, as shown in FIG. 8. The front end surface of the conical protruding part 13 is provided with an annular conductive plate 14 that is sleeved on the straight bar 1. The front side surface of the annular conductive plate is provided with an outer conductive ring 15 and an inner conductive ring 16. As shown in FIG. 10, the annular conductive plate 14 can be embedded in the rear end portion of the sleeve 6, such that the outer conductive ring 15 and the inner conductive ring 16 are respectively in communication with the positive electrode post 12 and the negative electrode post.

Figure 9:
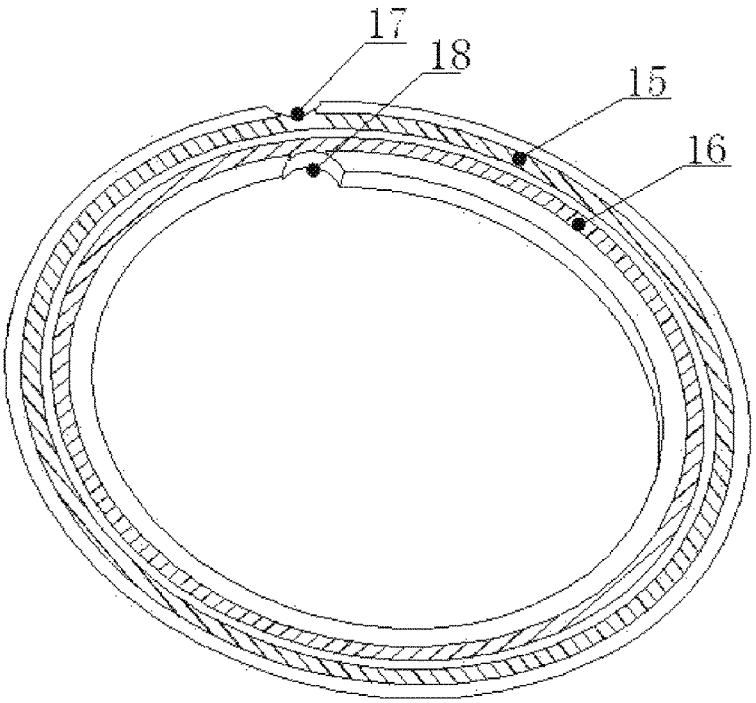
FIG. 9 is a schematic structural view of an annular conductive plate.

An outer circumferential edge and an inner circumferential edge of the annular conductive plate 14 are respectively provided with an outer notch 17 that facilitates bonding wire and an inner notch 18, as shown in FIG. 9. The outer notch 17 and the inner notch 18 are respectively connected with the outer conductive ring 15 and the inner conductive ring 16. Therefore, power is supplied to the laser module.

Figure 11:
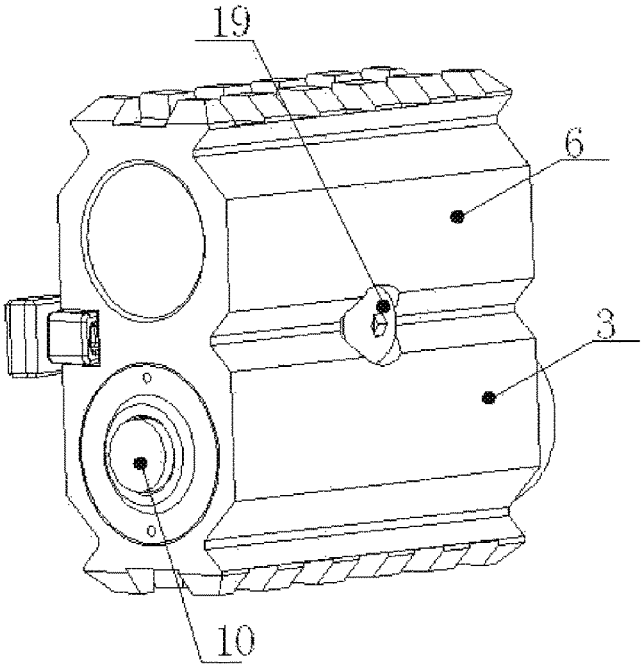
FIG. 11 is an isometric view of the opposite side of FIG. 10.
Figure 12:
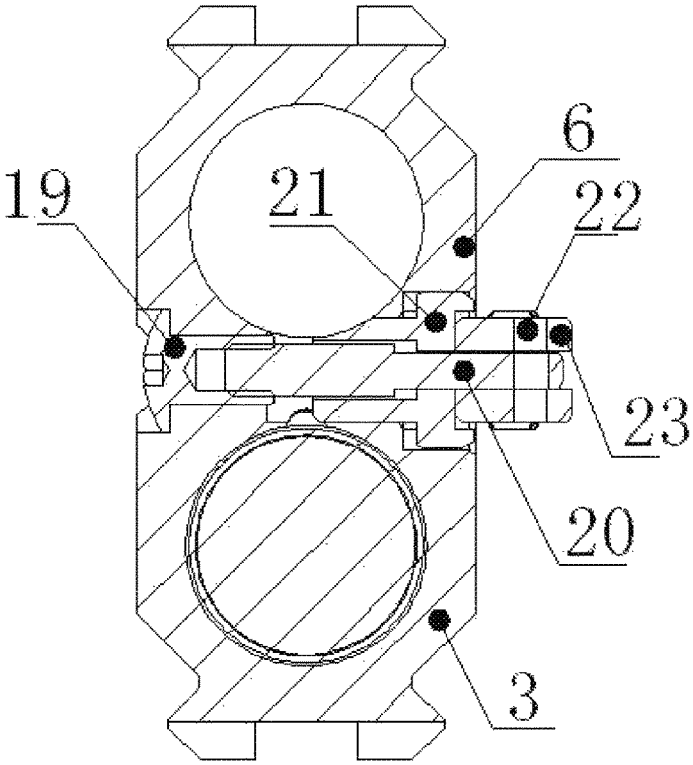
FIG. 12 is a schematic cross section view in which the battery cabin is integrally fit with the sleeve.
Figure 13:
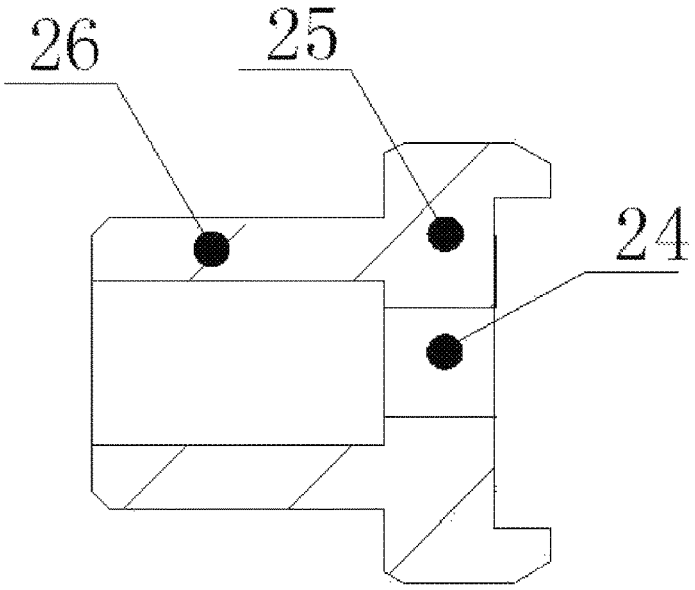
FIG. 13 is a schematic structural view of a movable clamp.

In order to fix the sleeve 6 and the battery cabin 3 on the straight bar 1, a clamp that may be clamped on the front end portion of the straight bar 1 is displaced at the connection of the battery cabin 3 and the sleeve 6. The clamp comprises: an inner thread connection sleeve 19 displaced on one side of the connection as shown in FIGS. 10, 11 and 12, a connection screw 20 across the connection, a movable clamping member 21 displaced in a groove on the other side of the connection, and a cam wrench 23 coupled to the end of the connection screw 20 that penetrates the movable clamping member 21 by a pin shaft 22. The movable clamping member 21 consists of a plate part 25 and a cylinder part 26, wherein the plate part 25 that is parallel to the side surface at the connection is provided with a horizontal via 24, as shown in FIG. 13, and the cylinder part 26 is fixedly connected to or integrated with the inner side surface of the plate part 25.

Figure 7B:
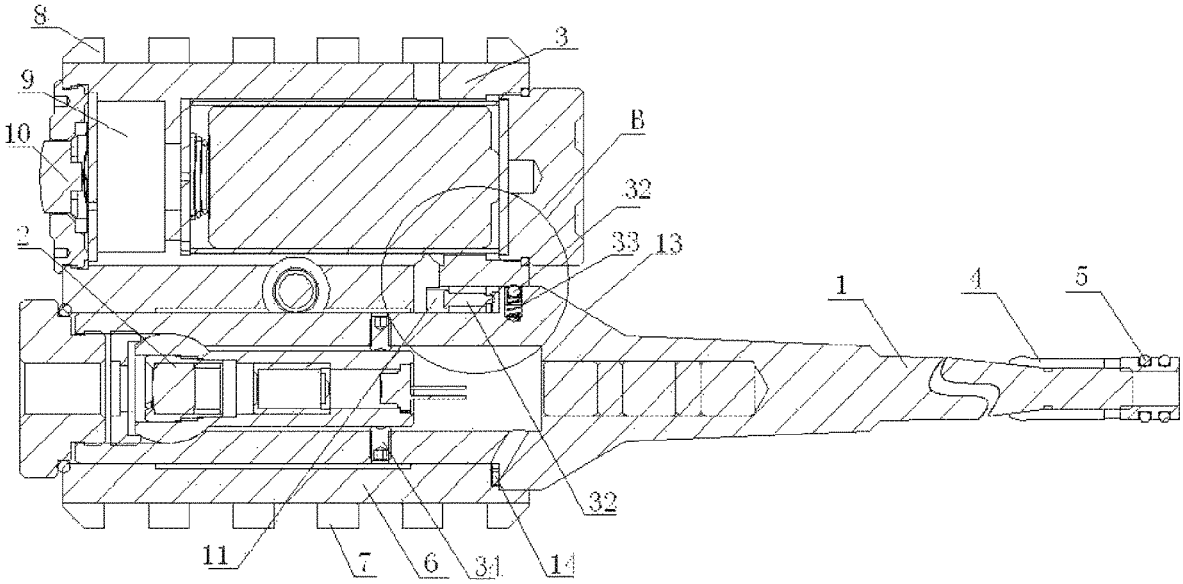
FIG. 7B is an axial cross section view of the gun calibrator that is provided with a conductive pillar, a conductive ball and a conductive spring.
Figure 7C:
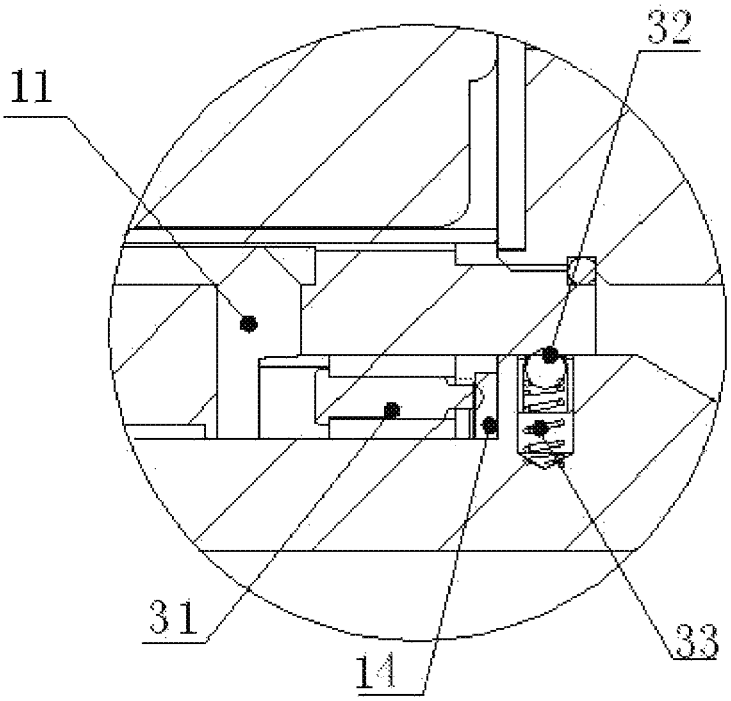
FIG. 7C is an enlarged view of portion B in FIG. 7B.

As shown in FIGS. 7B and 7C, a conductive pillar 31 is displaced at the rear end portion of the bottom surface of the sleeve 6 and is parallel to the axial direction of the straight bar 1. A conductive ball 32 and a conductive spring 33 are embedded in the circumferential surface of the straight bar 1, which is embedded in the sleeve 6, and the conductive ball 32 and the conductive spring 33 are perpendicular to the straight bar 1. The conductive ball 32 is pressed against the surface of the battery cabin 3 under the pressure of the conductive spring 33, so as to be embedded in the rear end portion of the sleeve 6 by the annular conductive plate 14. The conductive ring 15 is in contact with the conductive pillar 31 to connect one electrode of the laser module 2 with an electrode of the battery placed in the battery cabin 3. The conductive ball 32 and the conductive spring 33 connect the housing of the battery cabin 3 and the shell of the sleeve 6. The other electrode of the laser module 2 is connected with the other electrode of the battery placed in the battery cabin 3.

Here, the front side surface of the annular conductive plate 14 is provided with only a conductive ring 15, which completes the connection of the conductive loop together with the conductive pillar 31.

As shown in FIG. 7B, the housing of the straight bar 1 is provided with a vertical adjustment screw 34 and a horizontal adjustment screw 34 for the laser module, which are used to adjust the position of the laser module 2 to achieve a good concentricity of the laser module 2 with the straight bar 1.

Figure 15:
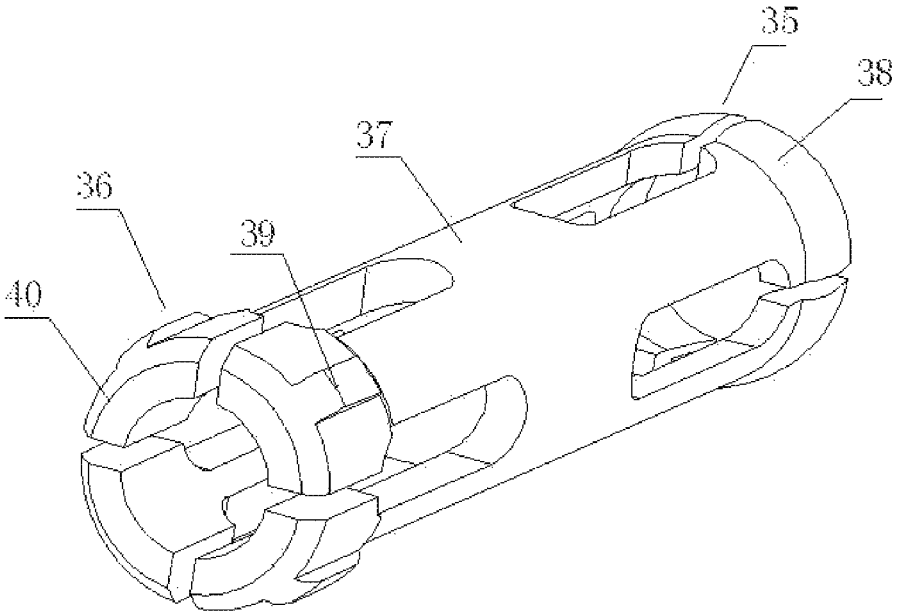
FIG. 15 is a schematic structural view of a newly designed expansion sleeve.

In order to ensure that the gun calibrator will be used many times, and that there will be not an unstable state for installing the gun calibrator due to the wear of the limit device, i.e., the expansion sleeve and the annular elastic member, in particular a rubber ring, and that the cost of maintenance is reduced and it is reliable in use, the present embodiment provides an expansion sleeve as shown in FIG. 15. As shown in FIG. 15, the front and rear ends of the expansion sleeve 4 are respectively provided with a front slip assembly 35 and a rear slip assembly 36.

The front slip assembly 35 and the rear slip assembly 36 are connected by the connecting cylinder 37. The front slip assembly 35 is surrounded to be a cylindrical shape by at least three front slips 38, the rear end of which is connected to the connecting cylinder 37 and the front end portion of which is spherical or arc-shaped face. A gap is provided between the adjacent front gaps 38, and the outer diameter of the front slip 38 is equal to the inner diameter of the barrel.

The rear slip assembly 36 is surrounded to be a cylindrical shape by at least three rear slips 40, the front end of which is connected to the connecting cylinder 37 and the rear end portion of which is spherical or curved face, and the outer wall of each spherical or curved surface is provided with a strip-shaped block 39 that can be embedded in a rifling groove of the barrel. A gap is provided between the adjacent rear slips 40.

The connecting cylinder 37 is screwed to the rear end of a straight bar 1.

This way, when the gun calibrator is rotated to be installed into the barrel, under the guide or limit action of a block 39 that can be embedded in a rifling groove of the barrel at the rear end portion of the rear slip 40 of the rear slip assembly 36 and under the limit action of the front slip 38 having an outer diameter equal to the diameter of the barrel, it is ensured that the expansion sleeve 4 is always rotated along the barrel rifling into the barrel, while the straight bar 1 (the rear end of the straight bar 1 is a truncated cone with an increasing diameter toward the front end of the straight bar 1) is in turn rotated forward, to create an outward compressive force on the front slip assembly 35, which causes the front slip 38 of the front slip assembly 35 to expand along the radius direction of the barrel to increase the fixing force of the barrel on the straight bar 1. On the rear slip assembly 36, the diameter for the circumference where the block 39 is located is equal to or slightly greater than the diameter of the circumference where the inside rifling of the barrel is located (generally, greater than the diameter of the circumference where the inside rifling of the barrel is located by 0 to 2 mm, preferably 0.2 to 0.6 mm, or 0.4 mm, 0.8 mm, 1.2 mm, and 1.6 mm etc., depending on the strength needed by actual design). When the slip assembly 36 is loaded into the barrel rifling, the slip 40 is contracted inward after being compressed to maintain the close contact between the block 39 and the rifling groove, further ensuring the stability of the straight bar 1.

The expansion sleeve 4 is made of metal such as aluminum or steel, has good hardness, and thus can be repeatedly used without damage, thereby reducing maintenance costs and ensuring the stability and reliability of installation of the gun calibrator.

The present disclosure has the following advantage: calibration can be realized indoors or under dim light via laser by adding or integrally forming the inner red dot sight; and calibration can be realized via the inner red dot when the intensity of ambient light is greater. Further, the laser and the inner red dot can be used simultaneously to calibrate the gun, such that the laser and the inner red dot are calibrated to one another. By adding the expansion sleeve in the rear end of the straight bar, it can be realized that during spiral propulsion of the straight bar the straight bar is in better and tighter contact with the inner wall of the barrel, thereby achieving that stability is reliable, skew is difficult to occur, coaxiality is good, and adjustment accuracy is enhanced. The battery cabin is detachably displaced from the laser device, which can ensure coaxial precision, provide a power supply with larger amount of power, and allow easy replacement of battery and easy installation and debugging, without affecting the adjustment of coaxiality. By the configuration of Picatinny rail, the calibration can be performed under intense light environment via the installed optical sight such as red dot laser sight. The height adjustment of the inner red dot sight can be realized by a cushion block, such that guns having different heights of sight bead can be calibrated.

What is claimed is:

1. A gun calibrator with an inner red dot sight, comprising:
a straight bar,
a laser module that is displaced in the front end of the straight bar and is coaxial with the straight bar, and
a battery cabin that is displaced in the front end of the straight bar, wherein the front end of the straight bar is provided with an inner red dot sight.

2. The gun calibrator with an inner red dot sight according to claim 1, wherein the inner red dot sight is displaced on a top end of the laser module.

3. The gun calibrator with an inner red dot sight according to claim 2, wherein the inner red dot sight is connected with the laser module by a Picatinny rail displaced on the top end of the laser module.

4. The gun calibrator with an inner red dot sight according to claim 3, wherein the inner red dot sight is connected with the top end of the laser module by a sight bracket, which is displaced in the bottom of the inner red dot sight and can be clamped by the Picatinny rail.

5. The gun calibrator with an inner red dot sight according to claim 4, wherein the laser module is displaced in the front end portion of the straight bar, and the Picatinny rail is displaced on the top end of the front end portion of the straight bar.

6. The gun calibrator with an inner red dot sight according to claim 1, wherein the rear end of the straight bar is a truncated cone with an increasing diameter toward the front end of the straight bar, on which an expansion sleeve that is coaxial with the straight bar is sleeved, and wherein an end of the expansion sleeve in which a longitudinal expansion gap is provided is sleeved on the straight bar, and at least one annular elastic member is sleeved on an outer wall of the other end of the expansion sleeve.

7. The gun calibrator with an inner red dot sight according to claim 1, wherein a sleeve that can be sleeved on the front end of the straight bar is displaced at the top surface of the battery cabin, and an inner hole of the sleeve is coaxial with the straight bar after installation.

8. The gun calibrator with an inner red dot sight according to claim 7, wherein the bottom surface of the battery cabin and the top surface of the sleeve are respectively provided with a Picatinny rail.

9. The gun calibrator with an inner red dot sight according to claim 8, wherein the top surface of the sleeve is connected with an inner red dot sight by the Picatinny rail.

10. The gun calibrator with an inner red dot sight according to claim 7, wherein a control circuit board is provided in an inner side of the front end portion of the battery cabin, and the front end portion is provided with a control button in communication with the control circuit board.

11. The gun calibrator with an inner red dot sight according to claim 7, wherein the top surface of the rear end of the battery cabin is provided with a through hole in communication with the rear end portion of the bottom surface of the sleeve, wherein the rear end portion of the bottom surface of the sleeve is provided with a negative electrode post and a positive electrode post having elastic property, which are displaced up and down.

12. The gun calibrator with an inner red dot sight according to claim 11, wherein the rear end of the straight bar that is in the central part near the battery cabin is provided with a conical protruding part with an increasing radius toward the battery cabin, and the front end surface of the conical protruding part is provided with an annular conductive plate that is sleeved on the straight bar, and the front side surface of the annular conductive plate is provided with an outer conductive ring and an inner conductive ring; wherein the annular conductive plate can be embedded in the rear end portion of the sleeve, such that the outer conductive ring and the inner conductive ring are respectively in communication with the positive electrode post and the negative electrode post with elasticity.

13. The gun calibrator with an inner red dot sight according to claim 12, wherein an outer circumferential edge and an inner circumferential edge of the annular conductive plate are respectively provided with an outer notch that facilitates bonding wire and an inner notch, and the outer notch and the inner notch are respectively connected with the outer conductive ring and the inner conductive ring.

14. The gun calibrator with an inner red dot sight according to claim 12, wherein a clamp that can be clamped on the front end portion of the straight bar is displaced at the connection of the battery cabin and the sleeve, and the clamp comprises: an inner thread connection sleeve displaced on one side of the connection, a connection screw across the connection, a movable clamping member displaced in a groove on the other side of the connection, and a cam wrench coupled to the end of the connection screw that penetrates the movable clamping member by a pin shaft; wherein the movable clamping member comprises a plate part and a cylinder part, wherein the plate part that is parallel to a side surface at the connection is provided with a horizontal via, and the cylinder part is fixedly connected to or integrated with an inner side surface of the plate part.

15. The gun calibrator with an inner red dot sight according to claim 7, wherein the top surface of the rear end of the battery cabin is provided with a through hole in communication with the rear end portion of the bottom surface of the sleeve, the rear end portion of the bottom surface of the sleeve is provided with a conductive pillar, which is displaced to be parallel to the axial direction of the straight bar; and a conductive ball and a conductive spring are embedded in the circumferential surface of the straight bar, which is embedded in the sleeve, and the conductive ball and the conductive spring are perpendicular to the straight bar; wherein the conductive ball is pressed against the surface of the battery cabin under the pressure of the conductive spring.

16. The gun calibrator with an inner red dot sight according to claim 15, wherein the rear end of the straight bar that is in the central part near the battery cabin is provided with a conical protruding part with an increasing radius toward the battery cabin, and the front end surface of the conical protruding part is provided with an annular conductive plate that is sleeved on the straight bar, and the front side surface of the annular conductive plate is provided with a conductive ring; the annular conductive plate can be embedded in the rear end portion of the sleeve, and the conductive ring is in contact with the conductive pillar to connect one electrode of the laser module with an electrode of the battery placed in the battery cabin; the conductive ball and the conductive spring connect a housing of the battery cabin and a shell of the sleeve, and connect the other electrode of the laser module with the other electrode of the battery placed in the battery cabin.

17. The gun calibrator with an inner red dot sight according to claim 15, wherein a clamp that can be clamped on the front end portion of the straight bar is displaced at the connection of the battery cabin and the sleeve, and the clamp comprises: an inner thread connection sleeve displaced on one side of the connection, a connection screw across the connection, a movable clamping member displaced in a groove on the other side of the connection, and a cam wrench coupled to the end of the connection screw that penetrates the movable clamping member by a pin shaft; wherein the movable clamping member comprises a plate part and a cylinder part, wherein the plate part that is parallel to a side surface at the connection is provided with a horizontal via, and the cylinder part is fixedly connected to or integrated with an inner side surface of the plate part.

18. The gun calibrator with an inner red dot sight according to claim 7, wherein a clamp that can be clamped on the front end portion of the straight bar is displaced at the connection of the battery cabin and the sleeve, and the clamp comprises: an inner thread connection sleeve displaced on one side of the connection, a connection screw across the connection, a movable clamping member displaced in a groove on the other side of the connection, and a cam wrench coupled to the end of the connection screw that penetrates the movable clamping member by a pin shaft; wherein the movable clamping member comprises a plate part and a cylinder part, wherein the plate part that is parallel to a side surface at the connection is provided with a horizontal via, and the cylinder part is fixedly connected to or integrated with an inner side surface of the plate part.

19. The gun calibrator with an inner red dot sight according to claim 18, wherein the inner red dot sight is connected to the Picatinny rail by a Picatinny rail for increasing height that has a rapid clamping structure.

20. The gun calibrator with an inner red dot sight according to claim 1, wherein the rear end of the straight bar is a truncated cone with an increasing diameter toward the front end of the straight bar, on which an expansion sleeve that is coaxial with the straight bar is sleeved; wherein the front slip assembly and the rear slip assembly are connected by the connecting cylinder; wherein the front slip is surrounded to be a cylindrical shape by at least three front slips, the rear end of which is connected to the connecting cylinder and the front end portion of which is spherical or arc-shaped face, and an outer diameter of the front slip is equal to an inner diameter of a barrel, and a gap is provided between the adjacent front slips; wherein the rear slip assembly is surrounded to be a cylindrical shape by at least three rear slips, the front end of which is connected to the connecting cylinder and the rear end portion of which is spherical or curved face, and the outer wall of each spherical or curved surface is provided with a strip-shaped block that can be embedded in a rifling groove of a barrel, and a gap is provided between the adjacent rear slips; wherein the diameter for the circumference where the block is located is equal to or slightly greater than the diameter of the circumference where the inside rifling of the barrel is located; and wherein the connecting cylinder is screwed to the rear end of a straight bar.

* * * * *